US006279720B1

(12) United States Patent
Delmenico et al.

(10) Patent No.: US 6,279,720 B1
(45) **Date of Patent: *Aug. 28, 2001**

(54) COIN HANDLING MECHANISM

(75) Inventors: Peter Delmenico, Evanston, IL (US); William R. George, Santa Cruz, CA (US)

(73) Assignee: Antares Applied Research, Inc., Evanston, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/537,039

(22) Filed: Mar. 28, 2000

Related U.S. Application Data

(63) Continuation-in-part of application No. 09/038,436, filed on Mar. 11, 1998, now Pat. No. 6,041,908.

(51) Int. Cl.[7] ..... G07F 1/04
(52) U.S. Cl. ..... 194/348
(58) Field of Search ..... 194/347, 348, 194/349, 344

(56) References Cited

U.S. PATENT DOCUMENTS

| | | | | |
|---|---|---|---|---|
| 931,847 | | 8/1909 | Dean et al. . | |
| 1,900,039 | | 3/1933 | Brandt . | |
| 2,057,737 | | 10/1936 | Patzer . | |
| 2,179,023 | | 11/1939 | Schauweker . | |
| 3,498,438 | | 3/1970 | Arzig . | |
| 4,062,435 | | 12/1977 | Chalabian . | |
| 4,230,213 | | 10/1980 | Spring . | |
| 4,306,644 | | 12/1981 | Rockola et al. . | |
| 4,346,798 | | 8/1982 | Agey, III . | |
| 4,799,580 | * | 1/1989 | Hall | 194/235 |
| 5,027,937 | | 7/1991 | Parish et al. | 194/348 |
| 5,082,099 | | 1/1992 | Abe . | |
| 5,090,548 | | 2/1992 | Hird et al. . | |
| 5,156,250 | | 10/1992 | Parish et al. . | |
| 5,299,673 | | 4/1994 | Wu . | |
| 5,513,738 | | 5/1996 | Hird et al. . | |
| 5,597,061 | * | 1/1997 | Nishiumi et al. | 194/348 |
| 5,647,470 | | 7/1997 | Bruner et al. . | |
| 5,791,450 | * | 8/1998 | Oden | 194/348 |
| 6,041,908 | | 3/2000 | Delmenico et al. | 194/348 |

* cited by examiner

*Primary Examiner*—Robert P. Olszewski
*Assistant Examiner*—Bryan Jaketic
(74) *Attorney, Agent, or Firm*—McDonnell Boehnen Hulbert & Berghoff

(57) ABSTRACT

A coin handling mechanism for conveying coins to a remotely positioned coin receptor which accumulates the deposited coins. There is a water trap positioned along a back wall of the housing for diverting the flow of liquid injected through the coin entrance slot downwardly along the back of the housing to a fluid collecting chamber. The water trap comprises intersecting vertical support members and horizontal cross bars. There is also provided a coin discharge chute having an adjustment mechanism to adjust the point of discharge of the coins.

17 Claims, 13 Drawing Sheets

COIN HANDLING MECHANISM

I. STATEMENT OF RELATED APPLICATIONS

This is a continuation-in-part application of Ser. No. 09/038,436 filed Mar. 11, 1998, now U.S. Pat. No. 6,041,908 issued Mar. 28, 2000.

II. FIELD OF THE INVENTION

This invention relates to coin receiving devices for use on vending machines, and more particularly, to a coin handling mechanism which diverts liquid from the coin entrance slot and keeps the liquid from entering the coin receptor. Furthermore, the mechanism includes provisions for providing an adjustable diverter mechanism at the output of the coin handling mechanism such that the coins can be accurately deposited into the coin receptor.

III. BACKGROUND OF THE INVENTION

There has existed a need for a reliable method for conveying coins from an entry point or slot on the front of a vending machine to a coin counting and validation mechanism located within the machine. This is normally accomplished with a device such as a coin chute, which usually consist of two or more plastic parts, bolted inside the vending machine door. Coin chutes used for this specific purpose have two openings. The first is located next to the entry slot on the vending machine to receive coins inserted by a customer. The second aperture is at the discharge end of the coin chute which is normally located just above the entry point to an electromechanical coin sorting, counting and storing device, generally called a coin receptor. Thus, the primary responsibility of the coin chute is to reliably convey coins from their point of insertion at the coin receiving slot to the discharge end located adjacent to the coin receptor. In the past, there has not been any adjustment mechanism to adjust the discharge end of the coin chute to allow for any adjustment and direction of the coin as it is discharged from the coin chute.

Another problem has developed with respect to vandals pouring or injecting a liquid, commonly salt water, into the coin chute. Generally, this is done by squirting the salt water into the coin entrance slot or aperture of the vending machine. In the past, the salt water would run down the coin chute and drip into the coin receptor. The salt water causes the coin counting and credit mechanisms to short circuit and malfunction. Often, this results in the vending machine discharging the improper amount or all of the merchandise. At other times, the shorted electrical circuits may cause money within the receptor to be dispensed through the change or coin return mechanism. Furthermore, the salt water can cause the receptor to be destroyed resulting in expensive repairs to the vending machine. Vandals also have a practice of sliding a flexible tube connected to a squeeze bottle down the coin chute. In this case, the salt water is injected very close to the coin receptor and often past the point of any anti-fluid feature.

Thus, there is a need for a coin chute for vending machines which diverts liquid which is injected into the coin entrance slot such that the liquid is diverted harmlessly away from the coin receptor. Furthermore, there is a need to provide an adjustment mechanism at the discharge end of the coin chute to minimize the possibility of coin jams from the coins not being properly aligned when they are discharged from the coin chute into the coin receptor.

In the past, no coin chute has ever been devised which provides adjustability of the coin discharge portion of the coin chute. Previously, the coin chute had its discharge end set in a predetermined position which was supposed to be in alignment with the receiving portion of the coin receptor. The problem was addressed by merely providing a funnel mechanism at the receptor to receive coins from the discharge end of the coin chute. However, this was not a satisfactory solution to the problem as the coin discharge chute did not always discharge the coins in a proper manner into the funnel such that the coins were received by the receptor. Furthermore, due to manufacturing tolerances of the components of a vending machine, and the variances between vending machine manufacturers, the coin discharge chute did not normally line up in the exact proper orientation with respect to the receptor such that jams will not occur.

Unlike the lack of inventions directed to an adjustable coin discharge chute, the prior art has addressed the problem of liquid diverters for vending machines. The earliest design for keeping liquid from the receptor is illustrated in U.S. Pat. No. 4,230,213 entitled "Liquid Rejecting Coin Chute". This device used a very simple grate at the bottom of the coin chute to divert coins in one direction yet allow liquid to pass through the grate and be discharged into a trough. However, this device did not minimize splashing of the injected liquid if injected under pressure.

U.S. Pat. No. 4,306,644 entitled "Coin Chute for Vending Machine" is similar to the '213 device in that the liquid is allowed to drop through a series of rib members which form an open bottom wall for the coin chute. The coins are deflected and the liquid passes through the ribs. Again, a shortcoming of this device is that it does not provide an effective means for draining away the fluid if it is injected under sufficient pressure.

Another liquid diverting device is illustrated in U.S. Pat. No. 4,346,798 entitled "Liquid Diverting Coin Hopper". In this device, the liquid flows along a first slanted surface which transports both liquids and coins. A second slanted surface traveling in the opposite direction from the first, diverts the coins toward the coin receptor yet has a plurality of openings which permit liquid to flow through the second slanted surface and into a liquid retaining compartment. This device does not provide for a means to control a liquid sprayed under any pressure.

U.S. Pat. No. 5,027,937 entitled "Liquid Diverting Coin Chute" provides a plurality of openings along the front surface of the coin chute, which is the same surface on which the coins slide. This device assumes that the liquid will enter the coin chute at a low velocity such that it flows along the front surface of the chute. It does not provide for controlling liquid injected at a substantial pressure which, in fact, strikes the rear of the chute and doesn't flow gently along the front surface of the chute.

None of the devices which are designed for liquid diversion will protect the coin receptor from the problem of the vandal inserting a flexible hose or tube down the coin chute. By manipulating the flexible tube, it can be placed past the location of the liquid diverting device. The prior art devices have not addressed this problem.

IV. SUMMARY OF THE INVENTION

Applicants' invention solves both the problem of providing a liquid diverting coin handling mechanism and also provides for adjustable means at the coin discharge end of the coin chute, so that coins will be directed accurately into the coin receptor. The invention comprises a housing having front, back and side walls with a coin receiving slot at the top of the housing. The housing is mounted to the door of a vending machine. There are a series of vertically disposed ribs at the back of the housing which are in substantially parallel alignment with each other. The ribs define liquid diverting channels which direct the flow of any liquid injected through the coin entrance slot downwardly along the rear wall of the housing to a fluid collecting chamber where it is discharged. There is also provided an adjustment mechanism on the exit portion of the coin chute to provide accurate alignment of the discharge of the coin chute with the entrance into the coin receptor.

Thus, it is an object of the invention to provide a coin handling mechanism for use on vending machines that safely redirects fluid injected into the coin entrance slot so that it will not enter the coin receptor. It is a related object to provide a coin handling mechanism which provides protection for the coin receptor from fluid, especially salt water, being injected into the coin handling mechanism. Yet another related object is to provide a coin handling mechanism which protects the coin receptor from electrical malfunctions as a result of fluid entering the coin receptor due to it being injected through the coin receiving slot.

Still another object is the object of providing a coin handling mechanism which redirects the flow of liquid injected through the coin receiving slot to the back wall of the coin handling mechanism where it can be safety and effectively diverted away from the coin receptor. Another object is to provide a coin handling mechanism that makes it difficult to insert and guide a flexible tube into the mechanism to a point beyond the fluid diverting apparatus.

Yet another object is the object of providing a coin handling mechanism which provides for an adjustable discharge chute such that it can be accurately positioned with respect to the coin receptor to minimize the likelihood of coin jams.

A related object to the improvements in the coin handling mechanism is the object of providing a coin handling mechanism which requires less maintenance and service calls, thereby resulting in lower operating expenses.

These and other objects and advantages will be apparent upon reading the description of the drawings and preferred embodiment of the invention.

V. DESCRIPTION OF THE DRAWINGS

VI. DESCRIPTION OF THE PREFERRED EMBODIMENTS

Figure 1:
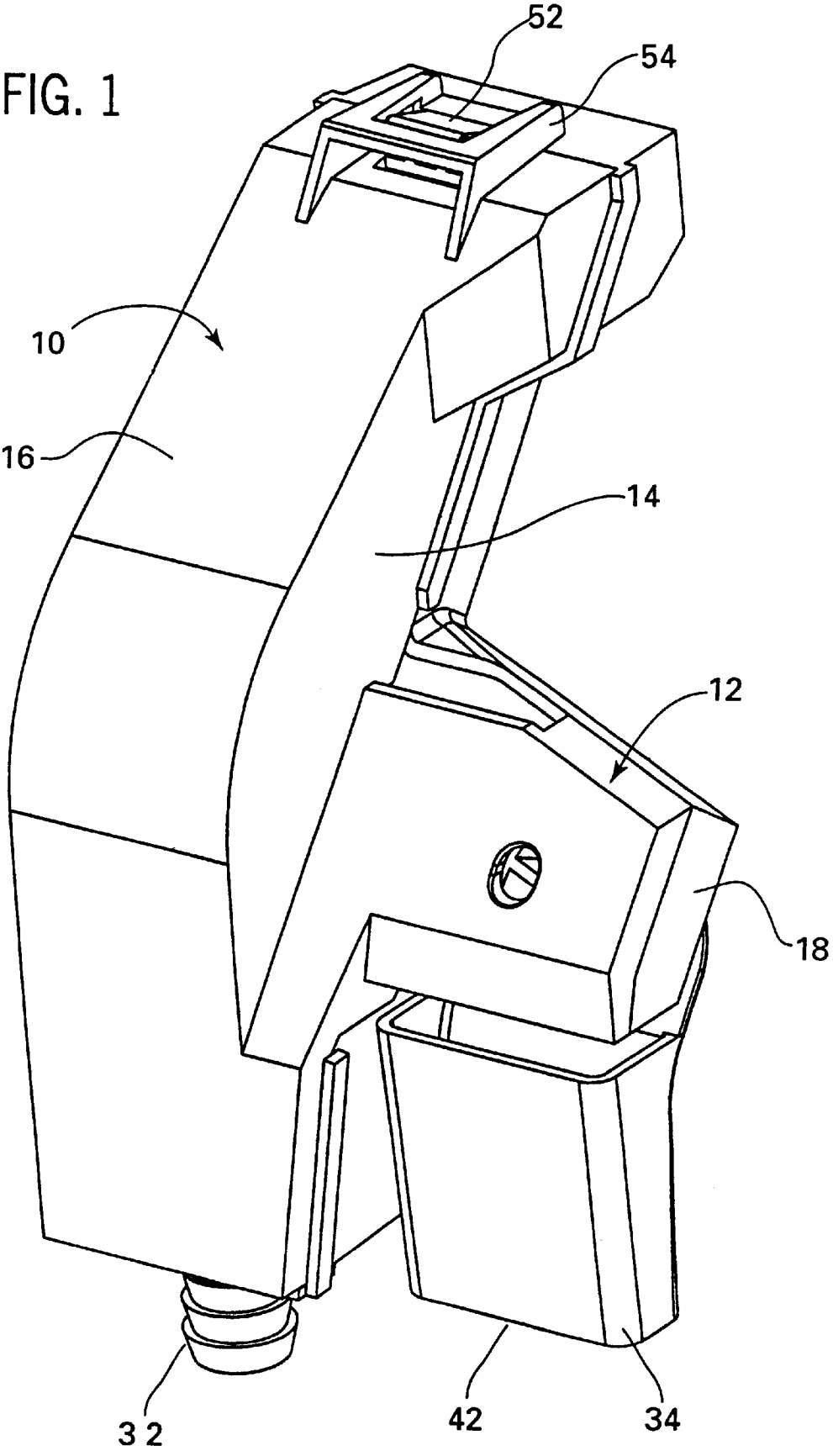
FIG. 1 is a perspective view of the coin handling mechanism as viewed from the inside of the vending machine looking toward the front door of the vending machine.

Turning first to FIG. 1 there is illustrated an inventive coin handling mechanism 10 embodying our unique design. It is comprised of a cover 12 having side walls 14 and 15, and a front wall 16.

Figure 2:
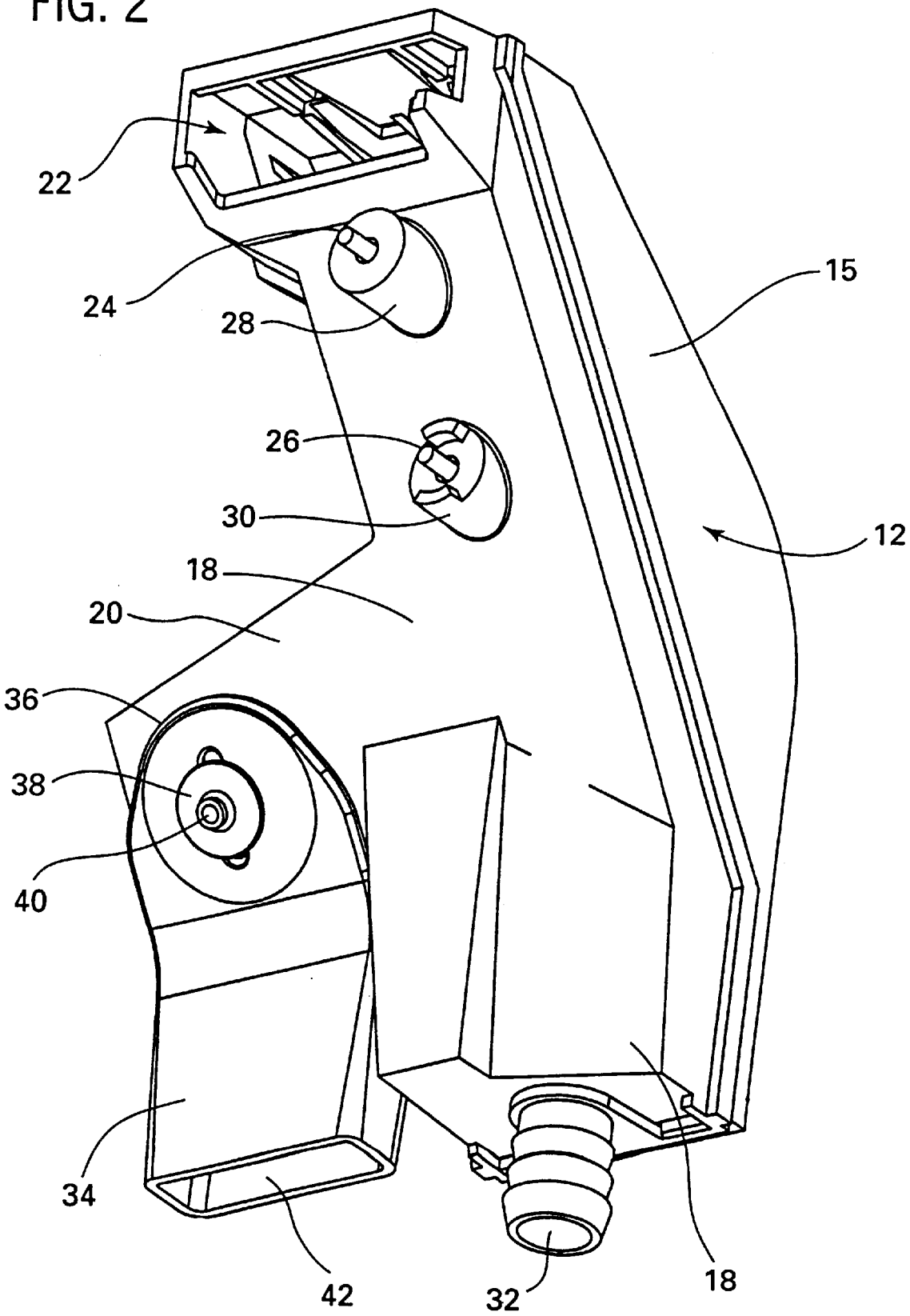
FIG. 2 is a perspective view of the coin handling mechanism as viewed looking toward the front door of the vending machine.

FIG. 2 illustrates the opposite side of the mechanism 10. There is a base 18 having a front wall 20. At the top of the base 18 is a coin receiving slot 22 at a top portion 23 of the base 18 through which the user of the vending machine deposits their coins generally with the coins in a horizontal plane. There are a pair of mounting screws 24, 26 which extend through the base 18 and into the rear of the front door of the vending machine (not illustrated). A pair of supports 28, 30 extend out from the base 18 in order to give structural support and stability to the base 18 when mounted against the vending machine door. At the bottom of the base 18 is a drain 32 which generally connects to a drain pipe or tube to dispel fluid collected within the coin handling mechanism 10.

There is also illustrated an inventive adjustable discharge chute 34 which is mounted to the base 18. A top mounting portion 36 of the discharge chute 34 is adjustably mounted to the base 18 by means of a clamp 38 and clamp fastener or screw 40. The adjustment mechanism will be more fully described later. There is also a discharge chute exit 42 disposed at the lower end of the discharge chute 34. In operation, it is important that the discharge chute exit 42 be aligned with the coin receptor (not illustrated) such that coins exiting the discharge chute 34 will drop into the receptor without interference from any other parts thus minimizing the possibility of coins jamming.

Figure 3:
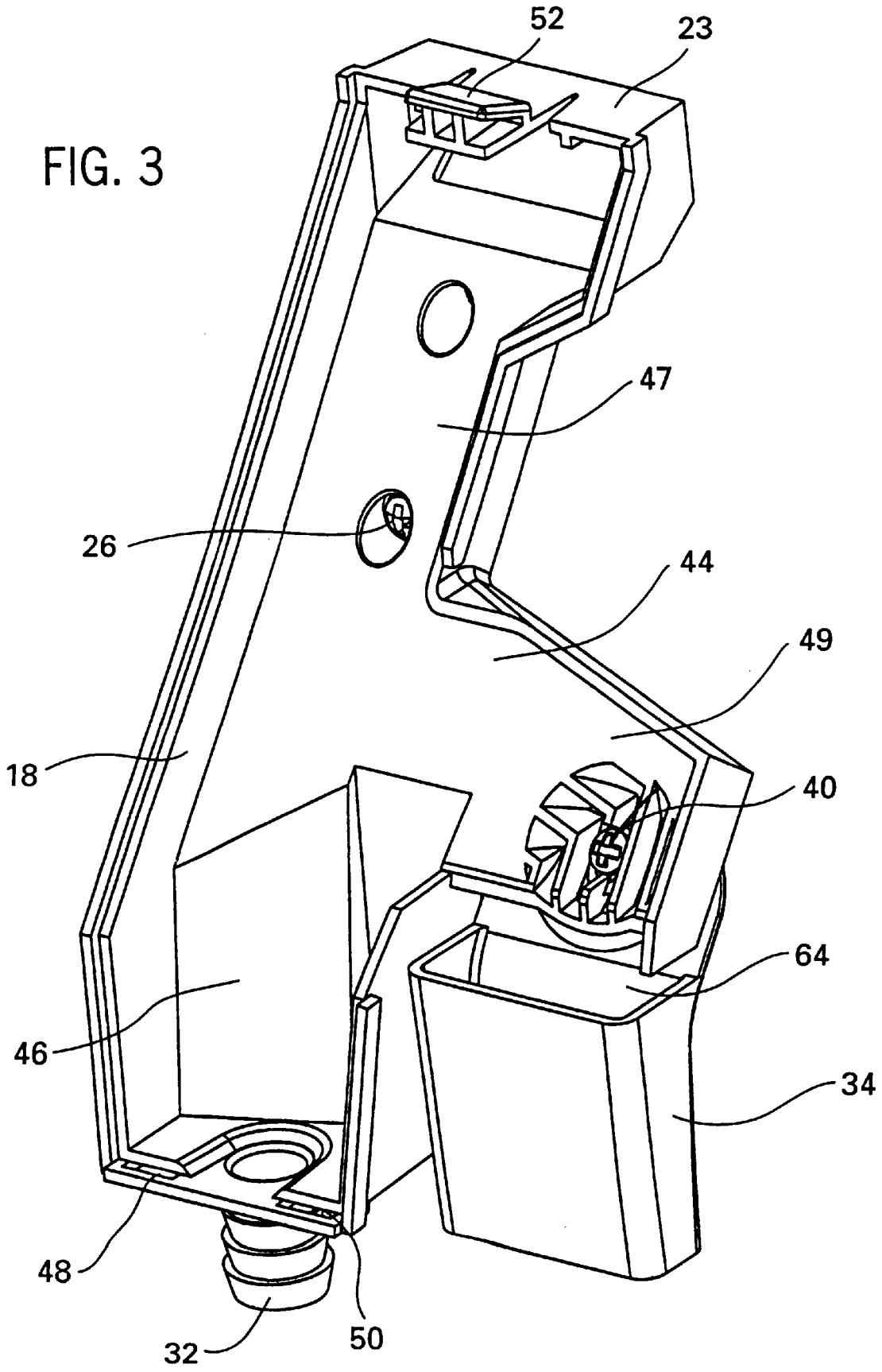
FIG. 3 is a perspective view of the coin handling mechanism taken from the same perspective as FIG. 1 with the cover of the coin handling mechanism removed exposing the base of the coin handling mechanism.

FIG. 3 illustrates the inside of the base 18 with the cover 12 removed. The base 18 has a back wall 44 which is a substantially smooth surface. The mounting screws or fasteners 24, 26 pass through this back wall and are received in the front door of the vending machine to hold the base 18 in place. There is a fluid collecting chamber 46 disposed at the lower portion of the base 18. There is a neck portion 47 extending from the coin receiving slot 22 to the fluid collecting chamber 46. Extending laterally from the neck portion 47 is an arm 49 through which coins are diverted to the discharge chute 42.

There are also a pair of slots 48, 50 at the lower end of the base. The slots receive complementary tabs 51 located on the bottom of the cover 12 in a retaining relationship. A latch 52 at the top 23 of the base 18 is received by a complementary latch closure mechanism 54 which is disposed at the top of the cover 12. The perimeter of the cover 12 is designed to substantially align with and seal against the perimeter of the base 18. The tabs 51 and slots 48, 50 at the bottom of the cover 12 and base 18 respectively retain the bottoms of these two structures together while the latch 52 and latch closure mechanism 54 releasably hold the top of the device in a locked relationship until such time as the latch 52 is pivoted to release the cover 12 from the base 18. Thus, a very simple, economical, yet structurally sound closure mechanism is provided for these two pieces which form the housing of the coin handling mechanism 10.

Figure 4:
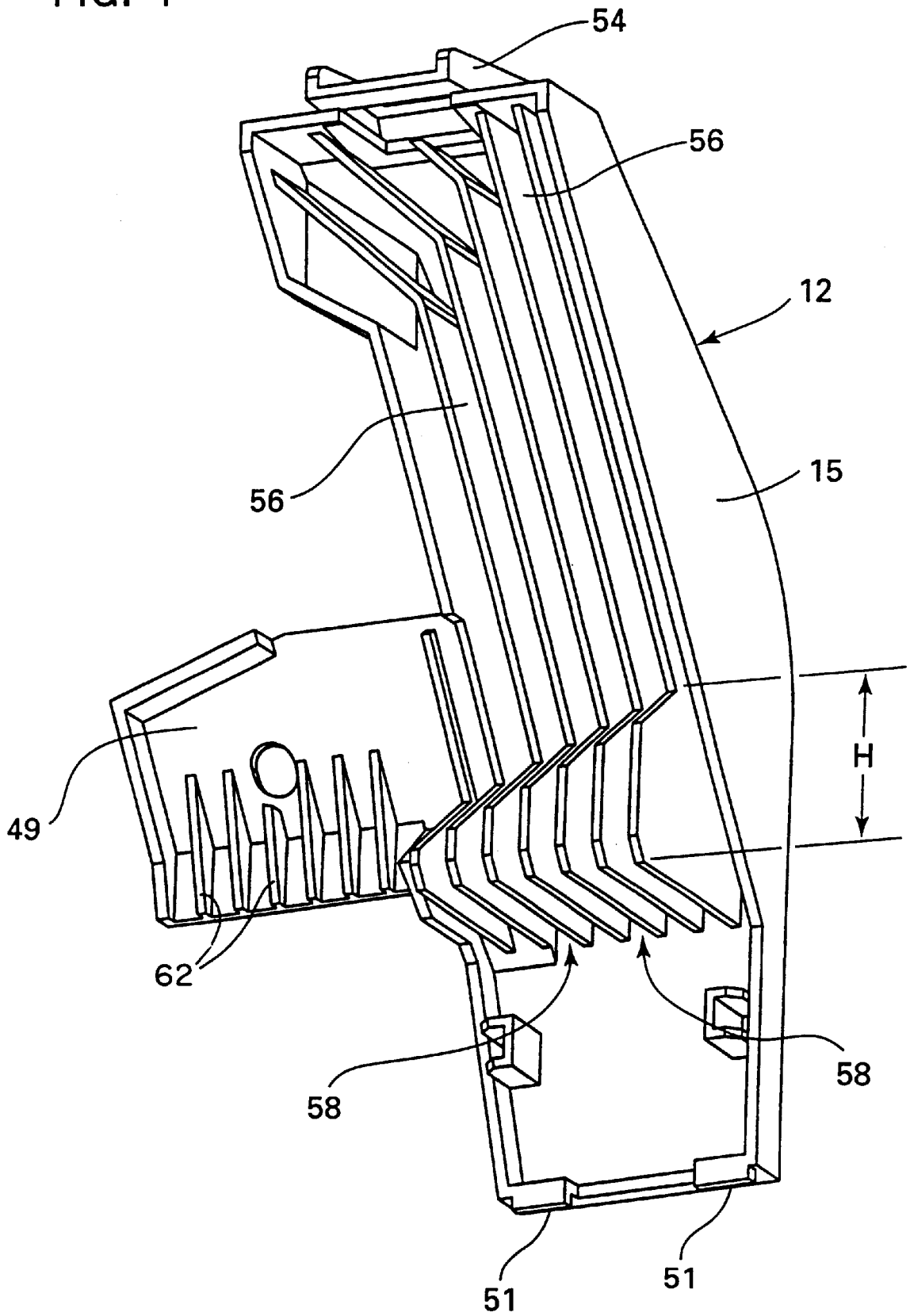
FIG. 4 is a perspective view of the inside of the cover of the coin handling mechanism.

FIG. 4 illustrates the unique inventive concept which diverts and directs the flow of any fluid injected into the coin receiving slot 22. Normally, when vandals try to squirt salt water into a vending machine, they use a squeeze bottle containing salt water. The nozzle of the squeeze bottle is inserted into the coin receiving slot 22 and the flexible walls of the bottle are squeezed, squirting the liquid into the slot 22. In prior art devices, this stream of fluid was turbulent inside the coin handling mechanism and often resulted in a portion of the liquid being discharged into the receptor. This is obviously undesirable in that it could short circuit the electrical components within the receptor causing the vending machine either to discharge its contents, discharge coins, or merely be ruined, causing an expensive service call and replacement of the receptor. In Applicants' device there are a series of ribs or partitions 56 extending in a plane perpendicular to the inside of the front wall 16 of the cover 12. The ribs 56 are preferably substantially parallel to each other although it is not critical that they are parallel. Channels 58 are formed between the ribs 56 and receive the fluid in such a manner as to break up the injected stream into separate streams which are received within the channels 58. This lessens the force of injected liquid and restricts movement of the stream of liquid so that it is very difficult, if not impossible, for the liquid to splash around in such a manner as to have a portion of the splashed liquid diverted into the receptor. Instead, the channels 58 direct the flow of liquid toward the inside surface of the front wall 16 of the cover 12. Surface tension assists in keeping the liquid attached to the ribs and within the channels so that the fluid will not drop off the ribs due to the effects of gravity but rather will flow along the ribs and inside surface of the cover down toward the fluid collecting chamber 46.

The ribs 56 also make it extremely difficult for vandals to slide a flexible tube connected to a squeeze bottle down into the mechanism beyond the neck portion 47. The ribs 56 tend to keep the flexible tube oriented vertically along the inside of the cover. Thus, any salt solution will be directed toward the fluid collecting chamber 46.

The configuration of the ribs is also unique. From the top 23 until a portion just above the fluid collecting chamber, the ribs are substantially of one height extending from the front wall 16. The height is selected so that when the cover 12 is snapped into engagement with the base 18, a slight gap exists between the top of the ribs 56 and the back wall of the base 44. This actually provides a thin passageway through which the coins will slide such that the surface of the coin will slide along a neck portion 47 along the back wall of the base 44 down toward the fluid collecting chamber 46. However, above the fluid collecting chamber 46, the ribs are of a greater height and, in fact, will be dimensioned to engage the back wall 44 of the base. This forms a stop and keeps the coins from dropping into the fluid collection chamber 46. As seen in FIG. 4, the height H of the protruding portion of each of the ribs decreases from the side wall 15 toward the arm portion 49 where they can be discharged into the discharge chute 34. In essence, this causes a sloping or tapering plane along the bottom portion of the ribs toward the arm portion. Thus, when the coins strike the bottom of the ribs, they will necessarily be diverted toward the arm portion 49. This function could also be accomplished by inserting a foraminous structure at the bottom of the ribs which, when properly dimensioned and angled, could accomplish the same purpose. However, for ease of manufacturing, it would be most economical to provide the varying height of the ribs as an integral part of the ribs themselves. The arm portion 49 of the cover 12 also has structural support ribs 62 which give structural support to the arm 49 and also act as guides for properly aligning the coins to be dropped into the chute 34.

The instant invention teaches away from the prior art in that the fluid is directed toward the back wall of the cover and within the channels 58. The prior art devices generally have any liquid directed along the neck portion 47 along with the coins. Both coins and liquid slide down toward the fluid collecting chamber 46 together. These devices operate under the assumption that both the coins and water will travel down the same surface. Our invention directs the flow of injected fluid to the back of the housing, not along the neck portion 47. This is the preferable direction for the fluid to flow rather than along the back wall 44 of the base 18. By manufacturing the cover 12 and base 18 from plastics with high surface energy, it will increase the effects of surface tension, with the result that fluids will tend to run along the ribs 56 down toward the fluid collecting chamber 56.

Another unique feature of the coin handling mechanism 10 is the adjustability of the discharge chute 34. Most discharge chutes in prior devices taper at their exit portions to limit the possible misalignment with the coin receptors. This tapering is often the cause of coin jams. As may be seen in FIGS. 5 and 6, the discharge chute 34 has a discharge chute entrance 64 which receives diverted coins discharged from the arm portion 49. By means of a unique adjustment mechanism, the discharge chute 34 and discharge chute exit 42 can be adjusted such that it can rotate and move vertically as seen in FIG. 7. With Applicants' invention, the chute exit 42 does not have to be tapered to allow for misalignment. The larger exit area 42 results in less possibility of a coin jam.

Figure 6:
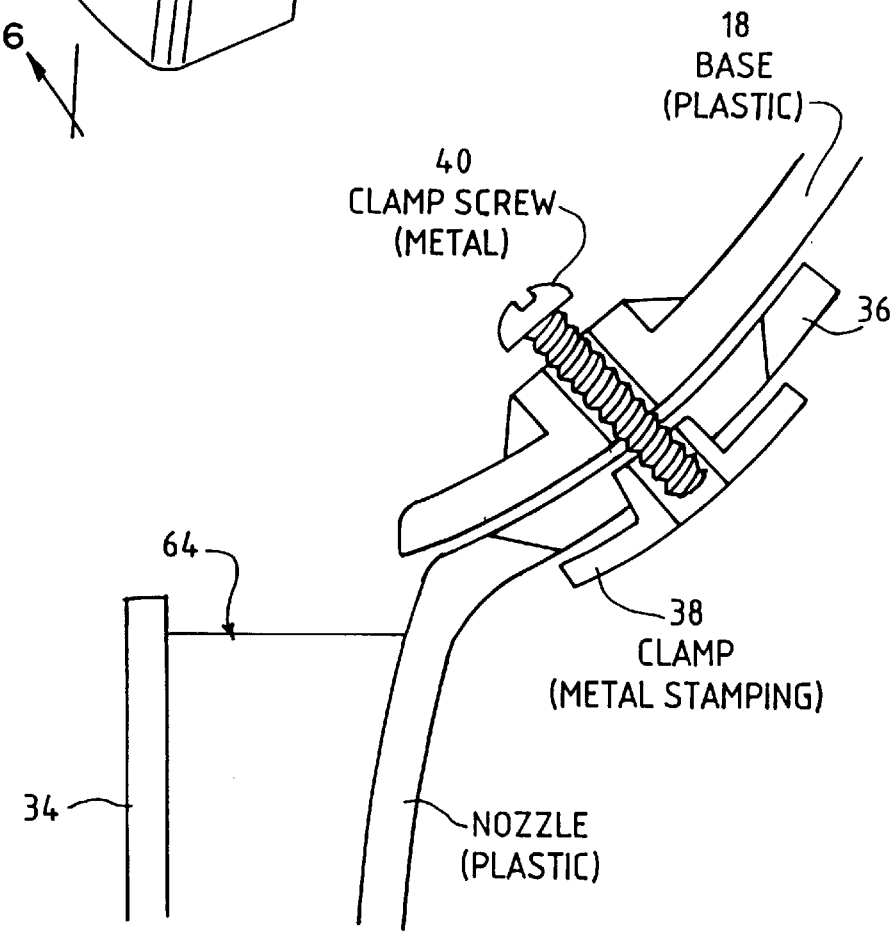
FIG. 6 is a cross sectional view of the discharge chute and mounting mechanism taken along line 6—6 of FIG. 5.
Figure 7:
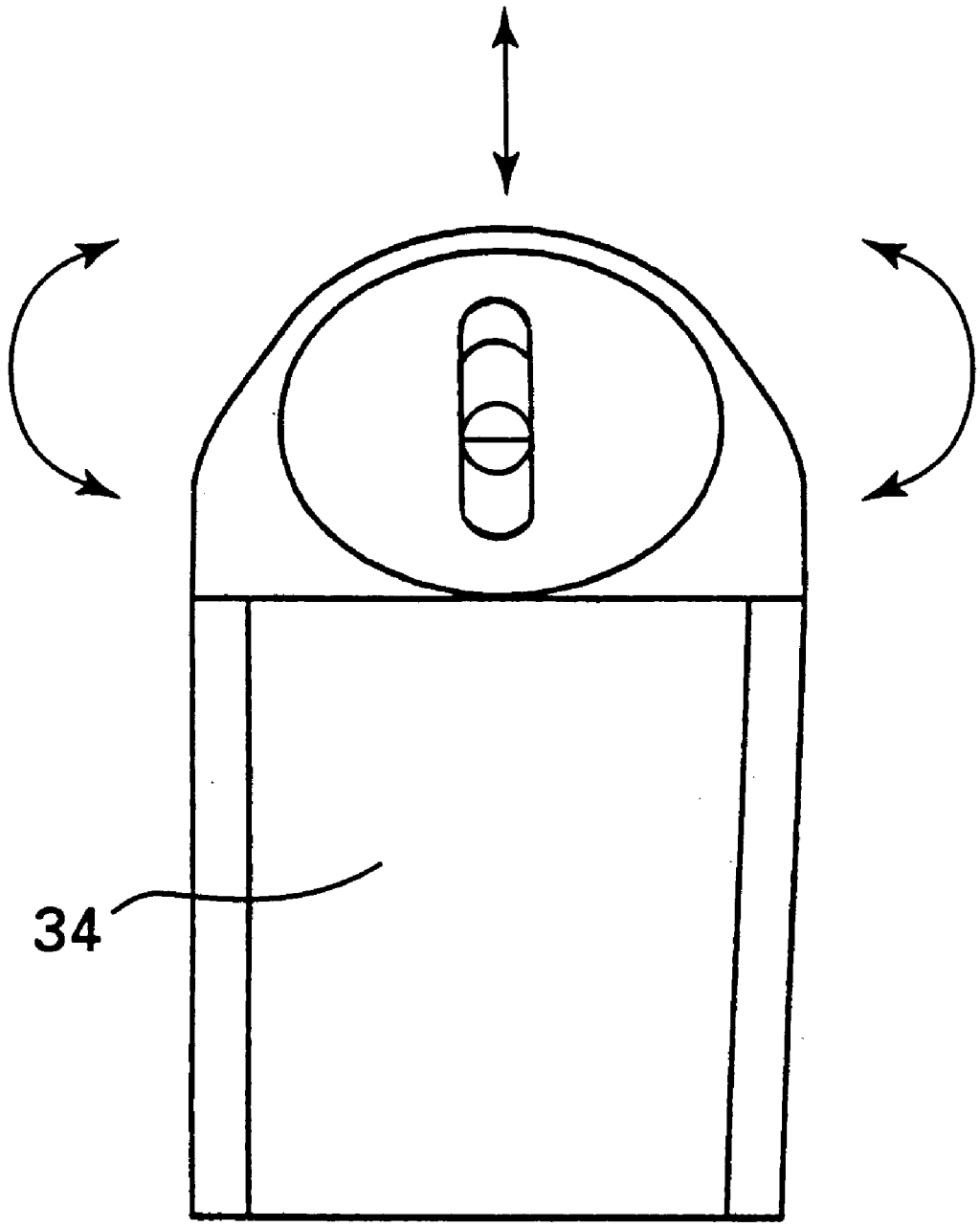
FIG. 7 is a view taken from the front of the vending machine facing toward the back of the vending machine showing the directions of adjustability of the discharge chute.

As best seen in FIG. 6, the clamp fastener or screw 40 passes through the base 18, through the top of the discharge chute 36 and into the clamp 38. By loosening the clamp screw 40, the top of the discharge chute 36 can move vertically up and down by means of the clamp member screw sliding within a slot 66 disposed in the top 36 of the discharge chute. The discharge chute 34 can rotate around the clamp screw 40 to move the discharge chute exit 42 laterally. This allows the discharge chute 34 to be accurately aligned with the coin receptor so that coins will be discharged directly into the receptor without the possibility of the coins jamming. By merely tightening the adjustment clamping screw 40, the position of the discharge chute 34 can be set and maintained. Due to the fact that there are numerous types of vending machines manufactured, and the tolerances of the manufacturers vary, along with the positioning of some of their components, it is advantageous to have the discharge chute 34 adjustable to compensate for these differences and tolerances of the various vending machines.

Although the adjustment and mounting mechanism for the discharge chute 34 is illustrated as a slot 66 within the top portion 36 of the discharge chute 34, it is evident that many different types of mechanical adjustment mechanisms could be implemented to provide adjustability in the orientation of the discharge chute 34 with respect to the coin handling mechanism 10. For example, a flexible plastic sleeve can connect the discharge chute 34 to the arm portion 49 of the base 18. The plastic sleeve retains the position to which it is moved to accurately position the discharge chute 34. Other types of pivots and slides can also be utilized to adjust the orientation of the discharge chute 34.

VII. DETAILED DESCRIPTION OF FURTHER EMBODIMENTS

Figure 8:
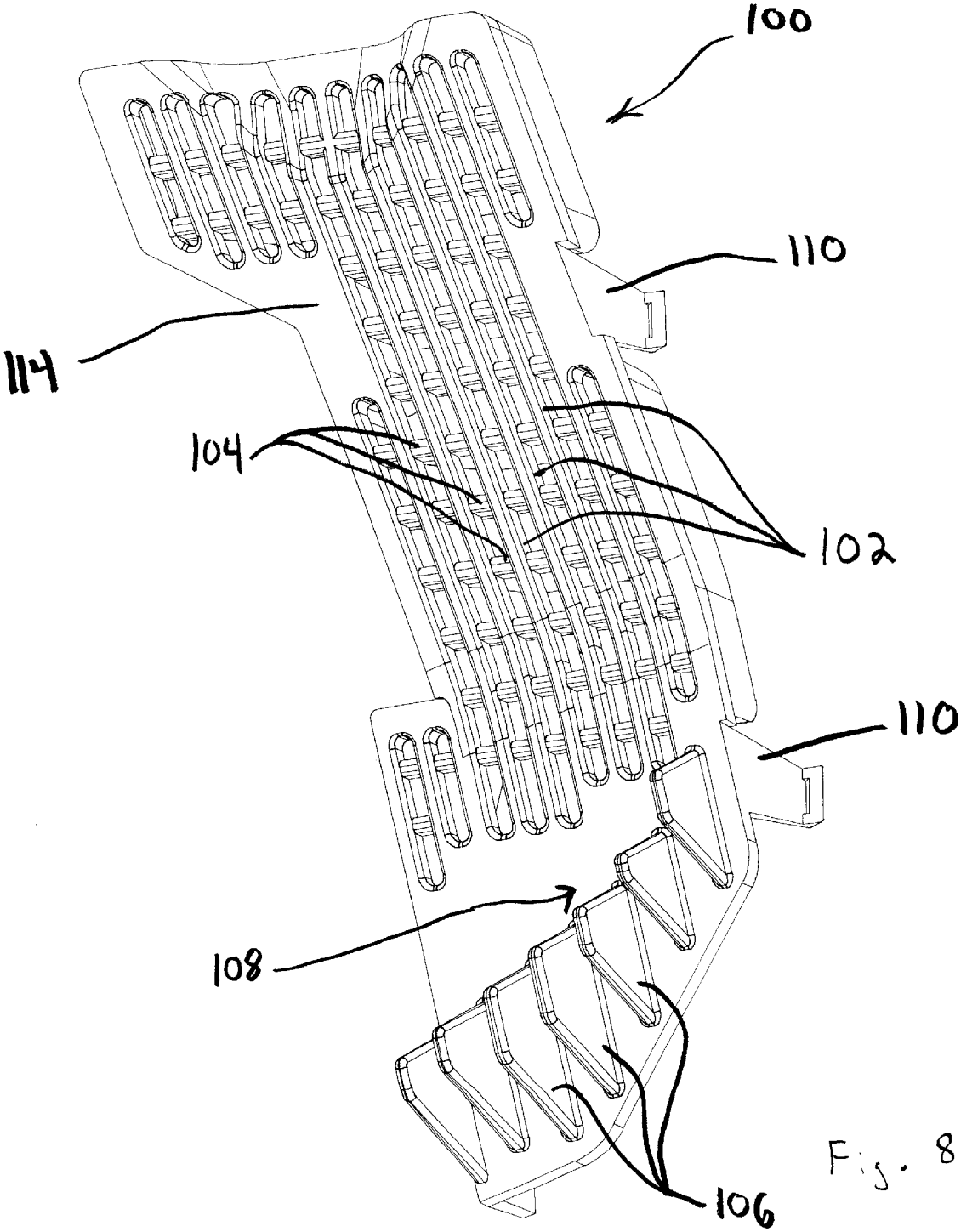
FIG. 8 is a perspective view of the front side of the water trap insert.

Turning to FIG. 8 there is shown a perspective view of the front side of water trap insert 100. Water trap insert 100 includes a series of vertical supports 102 and a series of horizontal crossbars 104 that intersect with vertical supports 102. When water is sprayed or injected into a coin handling mechanism, the water passes between vertical supports 102 and horizontal crossbars 104 towards the back of the housing and is directed to a drain. Water trap insert 100 also includes a plurality of outwardly extending vertical tabs 106 that serve as a coin passageway 108. As shown in FIG. 8, the coin passageway 108 slopes downwardly from right to left to provide a natural gravitational path towards the discharge chute for the coins. Water trap 100 also includes snap fingers 110 for attachment to the back of the housing. Snap fingers 110 are received into corresponding snap finger slots located in the back of the housing (not shown). Although snap fingers 110 are disclosed herein, those of skill in the art will recognize that there are many alternative, equivalents ways to attach water trap insert 100 to the back of the housing. Preferably water trap insert is an injection molded article comprised of a plastic that may be substantially transparent (for easy inspection) and which possesses good impact strength and material compatibility with a wide range of liquids. Suitable materials are clarified polypropylene or transparent ABS, although there are a wide range of plastics that could be employed.

Figure 9:
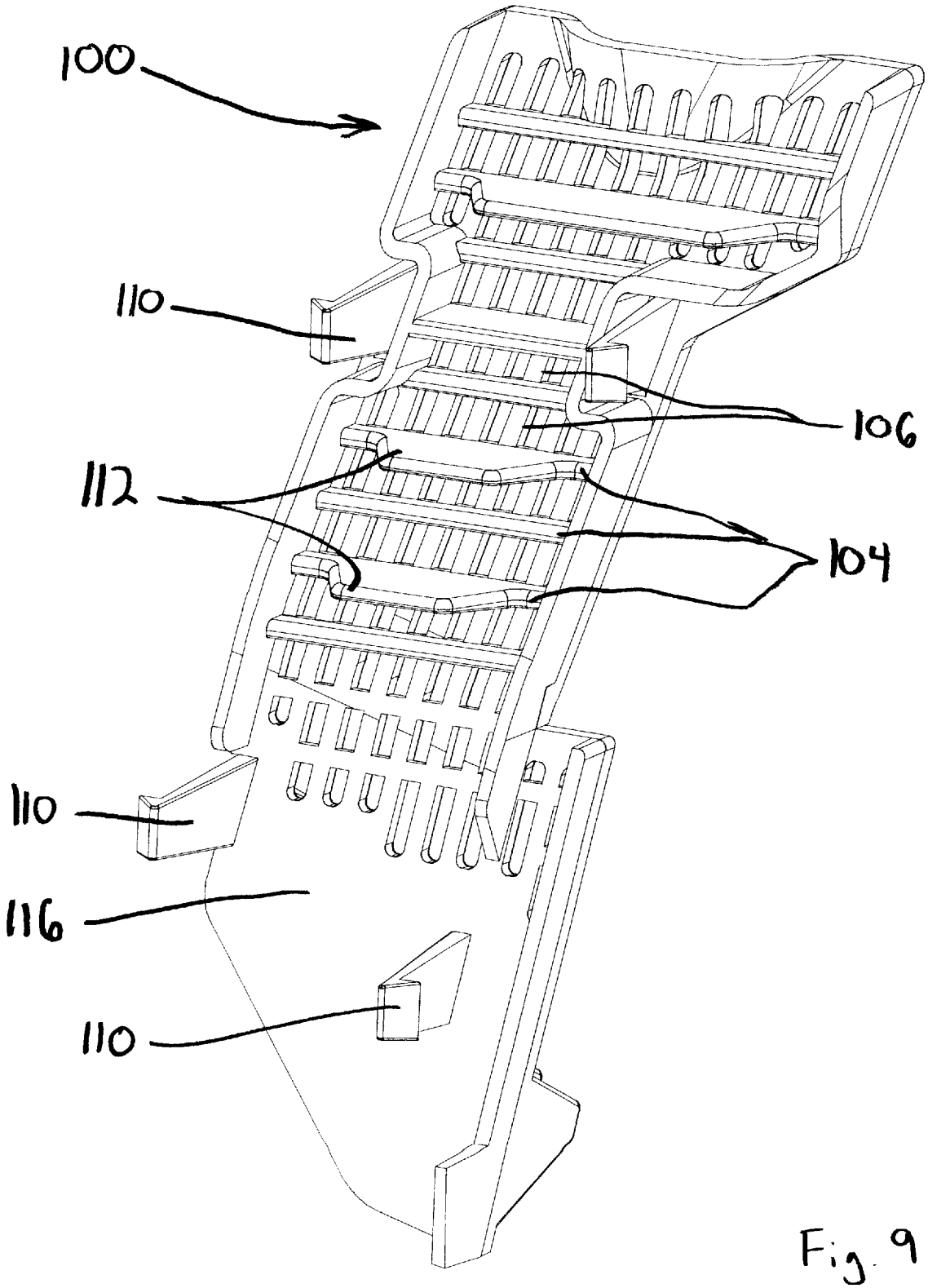
FIG. 9 is a perspective view of the back side of the water trap insert shown in FIG. 8.

FIG. 9 shows a perspective view of the back side of water trap insert 100 shown in FIG. 8. As shown in FIG. 9, horizontal cross bars 104 intersect with vertical supports 106. Preferably horizontal cross bars 104 include deflection fins 112 that extend away from the back side of the water trap insert 100 towards the back of the housing. Preferably each cross bar 104 includes a deflection fin 112 and preferably deflection fins 112 extend downwardly from the back side of the water trap insert 100. The deflection fins 112 may downwardly extend from the back side of the water trap insert. Deflection fins 112 serve to deflect water sprayed into a coin handling mechanism such of the type shown in FIGS. 1–3 and to prevent water splashing off of the back of the housing into the coin passageway, the coin discharge chute or the coin receptor.

FIG. 9 further shows deflection fins 112 extending from the back side 116 of water trap insert 110 and FIG. 8 shows vertical tabs 106 extending outwardly from the front side 114 of the water trap insert. Also shown are snap fingers 110 in FIGS. 8 and 9. As illustrated in FIGS. 8 and 9, openings are formed between the vertical tabs 106 and the horizontal cross bars 104 However, those of skill in the art will recognize that apertures of other geometric configurations than those shown may be suitably employed and still achieve the benefits of a water trap uniquely located at the back of the housing.

Figure 10:
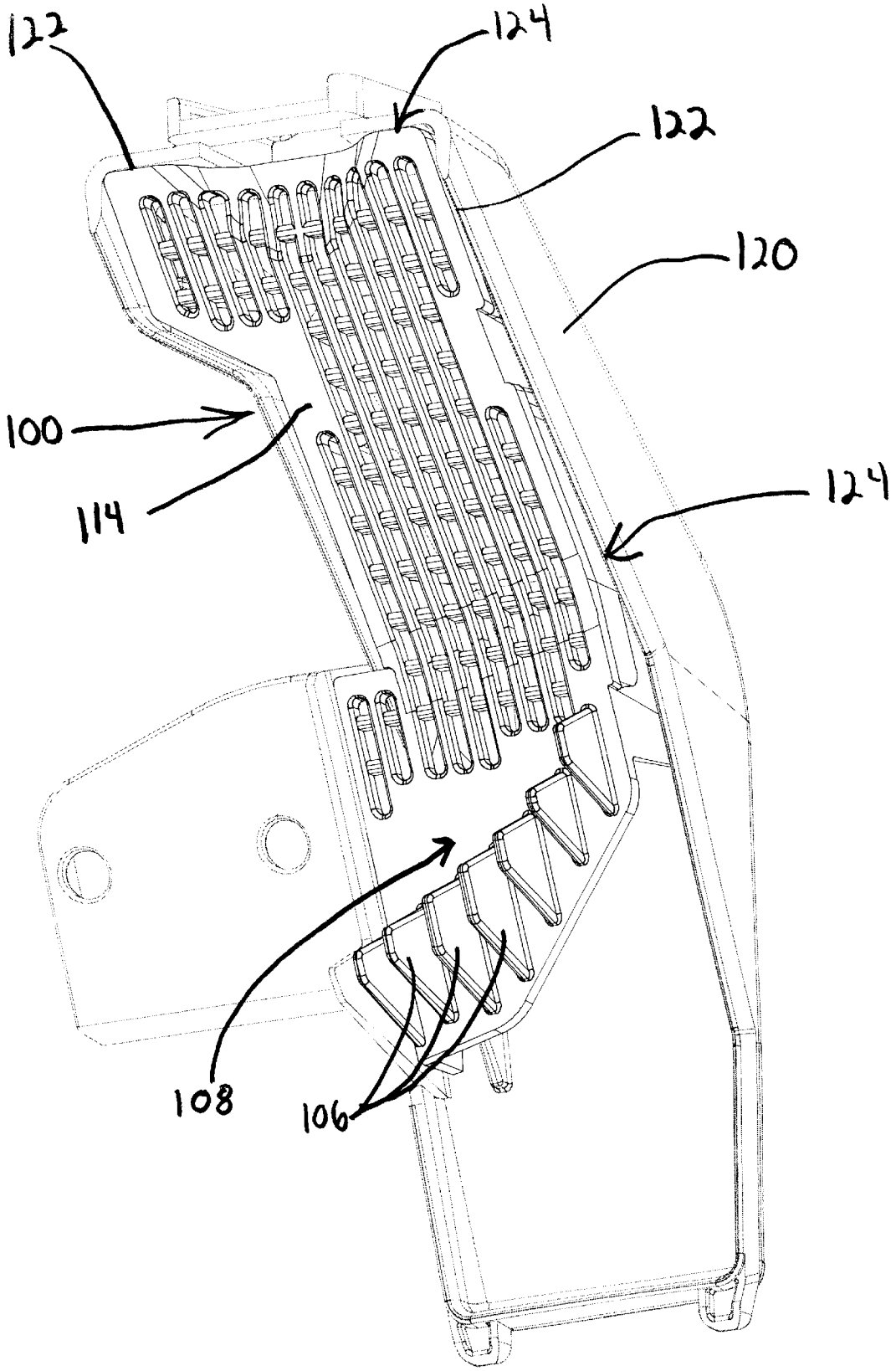
FIG. 10 is a perspective view of the water trap insert shown in FIGS. 8 and 9 attached to back of the housing.

FIG. 10 illustrates a perspective view of water trap insert 100 attached to the back of the housing 120. This shows an alternative to the portion of the housing shown as reference numeral 12. This embodiment retains the counterintuitive concept of providing a water trap on the back side of the housing opposite to the side upon which coins are conveyed. Thus, unique water trap insert 100 shown attached to the back of the housing 120 may be used in place of the embodiment shown in FIG. 4. As shown in FIG. 10 the periphery 122 of water trap insert 100 conforms to the periphery 124 of the back of the housing 120. In addition, vertical tabs 106 extend outwardly from the front side 114 of water trap insert 100 in similar fashion to the rib protrusions shown at the bottom of ribs 56 shown in FIG. 4. Thus vertical tabs 106 form a coin passageway 108 between the front and back of the housing.

Figure 11:
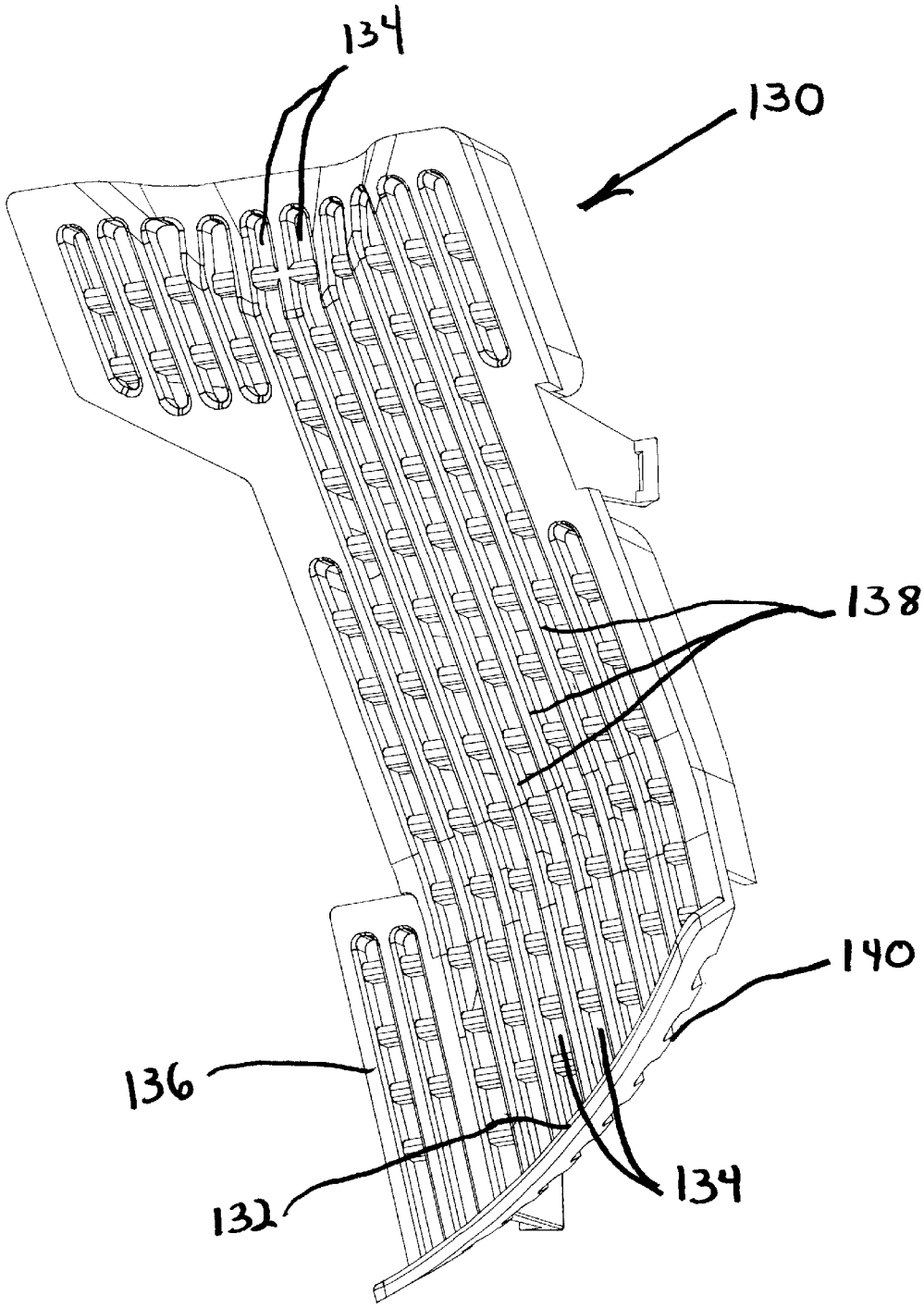
FIG. 11 is a perspective view of an alternative embodiment of the water trap insert.

FIG. 11 shows a modified version 130 of water trap insert 100. Modified water trap insert 130 includes a coin passageway 132 extending outwardly from front side 136 of water trap insert 130. As shown in FIG. 11, coin passageway 132 slopes downwardly from right to left to provide gravitational assistance to the coin and convey the coin towards the coin discharge chute. In this embodiment, vertical passages 134 are provided between vertical supports 138 and extend all the way to the intersection 140 of the coin passageway 132 and the front side 136 of water trap insert 130. Coin passageway 132 may also slope inwardly towards front side 136 so that any water will be directed toward the vertical passages 134 at intersection 140.

Figure 12:
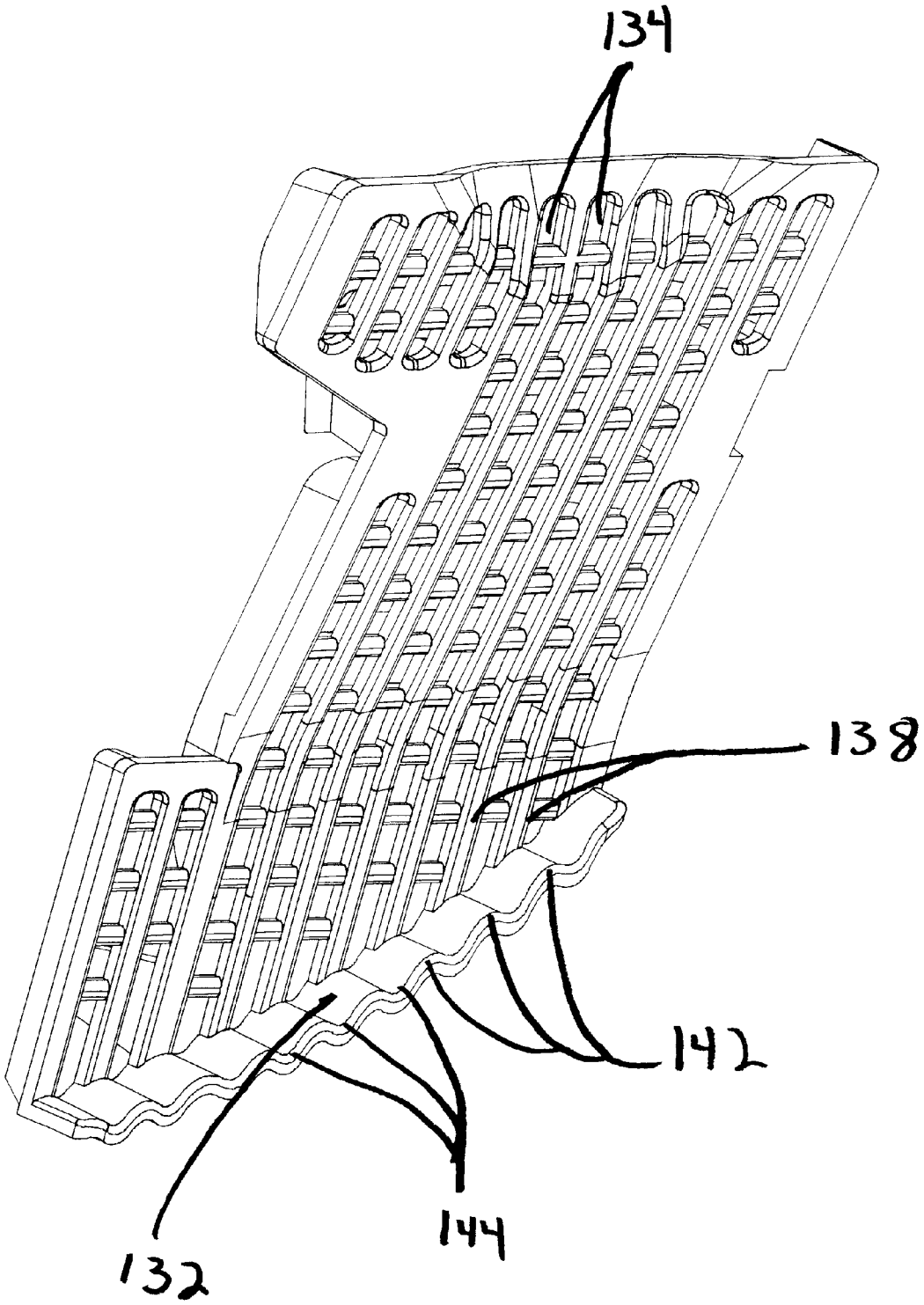
FIG. 12 is a perspective view of an alternative embodiment of the water trap insert.

As shown in FIG. 12, although not required, coin passageway 132 also preferably includes a series of hills 142 and dales 144 wherein the hills preferably intersect with vertical supports 138 and the dales preferably intersect with vertical passages 134. The hills 142 and dales 144 may be set at an angle to help divert liquid towards the back of the housing and away from coin passageway. The hills and dales 142 and 144 serve to prevent water from passing over the coin passageway towards the coin discharge chute and serve to divert water towards the back of the housing.

Figure 5:
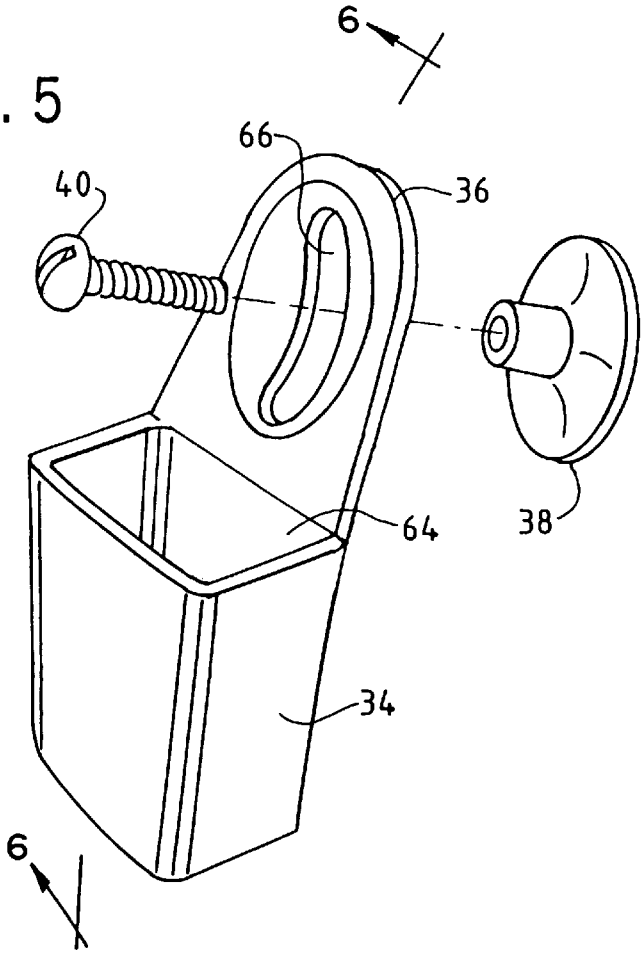
FIG. 5 is a perspective view of the adjustable discharge chute with its mounting means exploded from the discharge chute.
Figure 13:
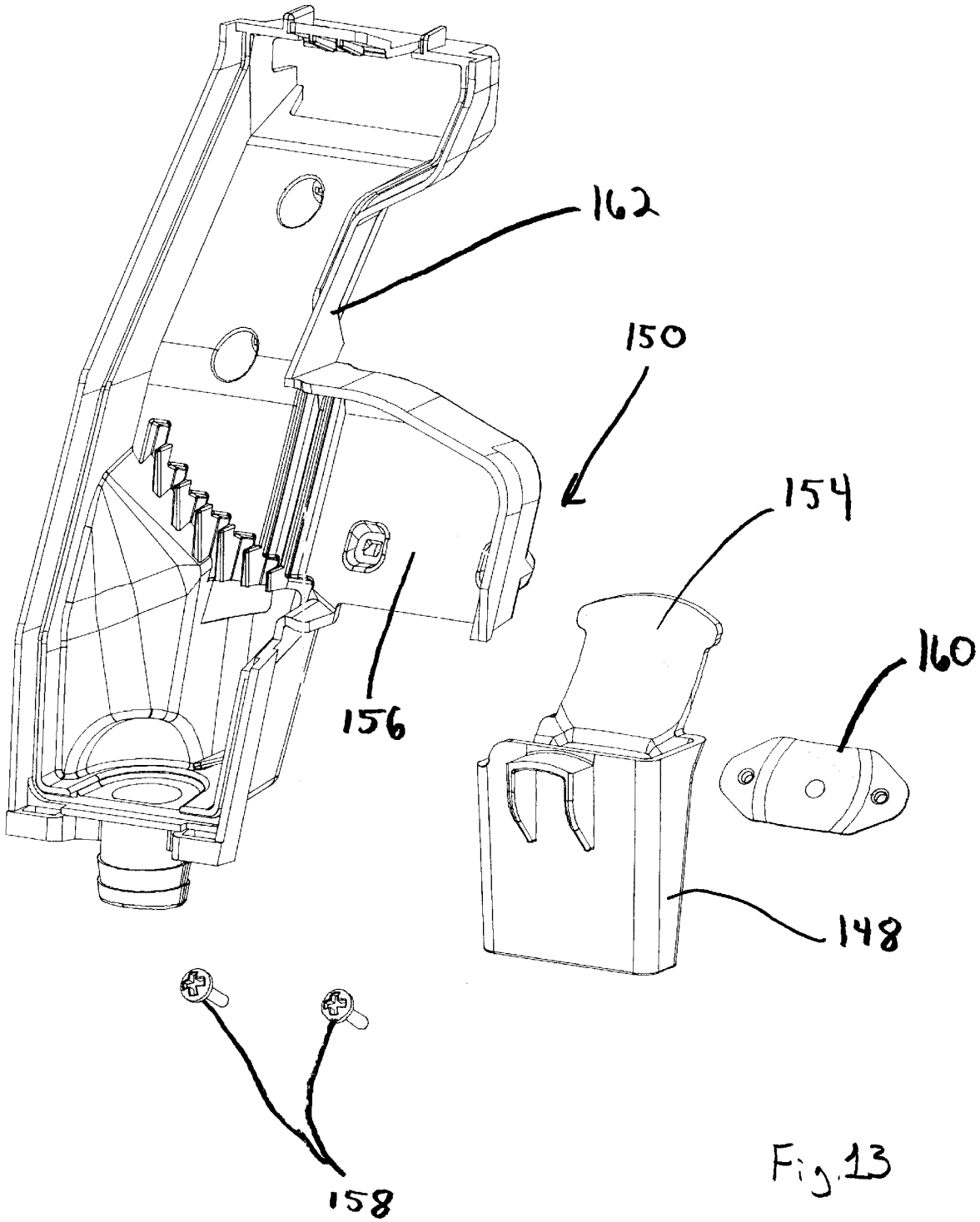
FIG. 13 is a perspective view of the back side of the front of the housing and showing an exploded view of an alternative mounting arrangement for the discharge chute.
Figure 14:
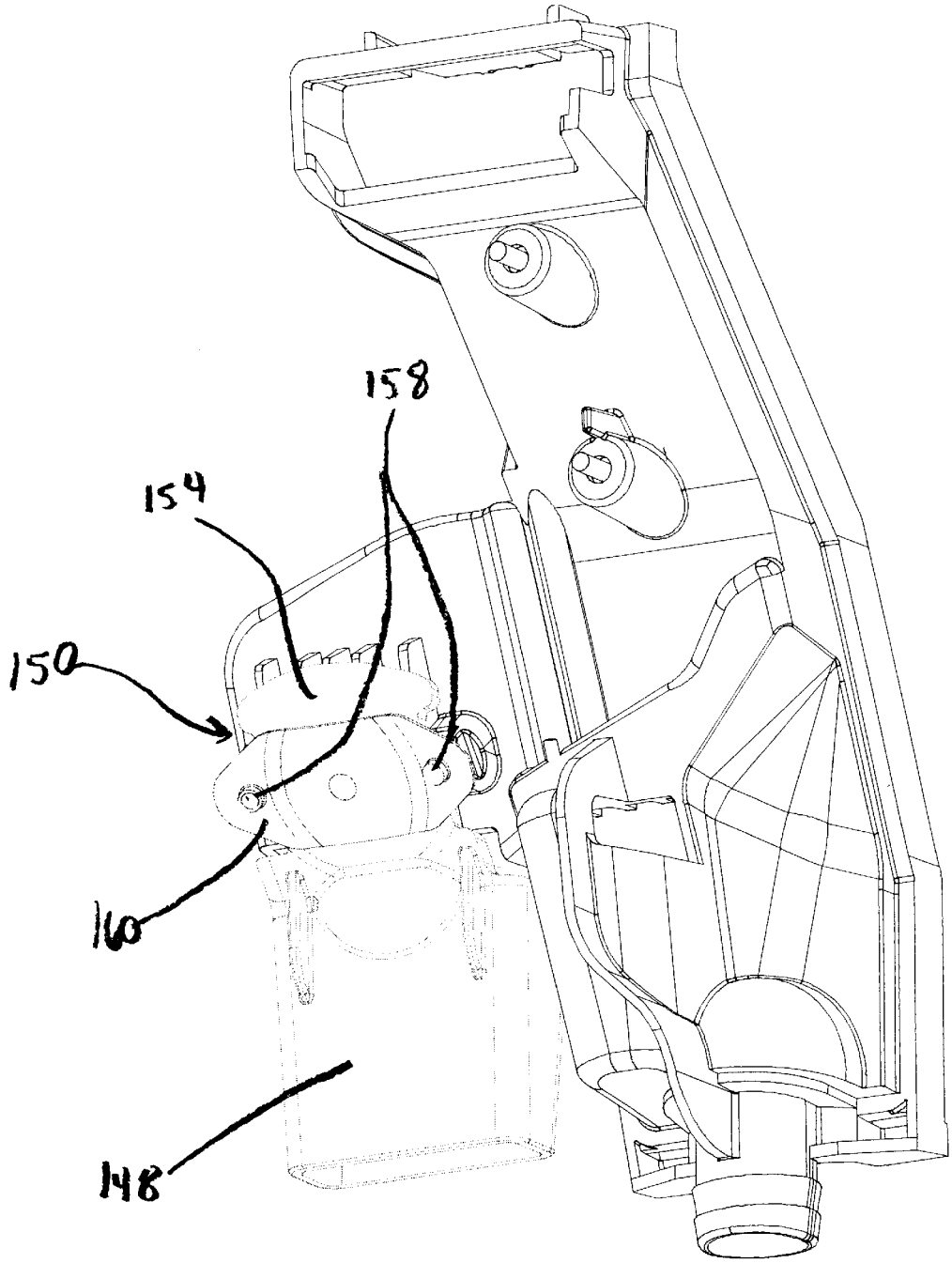
FIG. 14 is a perspective view of the coin handling mechanism as viewed looking toward the front door of the vending machine, and showing an alternative mounting arrangement for the discharge chute.

FIG. 13 shows an alternate coin discharge chute adjustment mechanism 150 similar to the adjustment mechanism illustrated in FIGS. 5 and 6. As shown in FIG. 13, adjustment mechanism 150 provides for both rotational and vertical adjustment of the bottom of the discharge chute 148 with a coin receptor to vary the location of coin discharge from the discharge chute 148. In particular, adjustment mechanism 150 includes discharge chute 148 having a tongue extension 154 for attachment to arm portion 156 of the front of the housing 162. Tongue extension 154 is adjustably attached to arm portion 156 by means of two screws 158 and a clamp plate 160. The angle and location of the discharge chute can be adjusted by loosening screws 158 and positioning tongue extension 154 in a desired relationship with clamp plate 160. When the desired positioning is attained, screws 158 are tightened and the discharge chute 148 is fixed in place. Clamp plate 160 is preferably made from a corrosion resistant material having suitable tensile properties. In a preferred embodiment the clamp plate is comprised of a phosphor-bronze material. Adjustment mechanism 150 provides for desired adjustment capabilities with respect to the positioning and location of the discharge chute that is absent in the prior art. FIG. 14 shows the opposite side of the coin discharge chute adjustment mechanism 150.

Thus, there has been presented a coin handling mechanism that fully satisfies the objects and advantages as set forth above. It is evident that many alternatives, modifications and variations will be apparent to those skilled in the art. Accordingly, it is intended to embrace such variations as fall within the spirit and broad scope of the intended claims.

We claim:

1. A liquid diverting coin handling mechanism for conveying coins to a remotely positioned coin receptor comprising:

a housing having a top, bottom, a front, a back, and side walls, a coin receiving slot disposed at the top and front of the housing, a coin discharge chute disposed in the housing below the coin receiving slot, a coin passageway upon which coins travel from the coin receiving slot to the coin discharge chute, a water trap positioned at the back of the housing and including a plurality of vertical support members and a plurality of horizontal cross bar members intersecting said vertical support members, wherein water injected into the coin handling mechanism may travel past the horizontal cross bar members and vertical support members and flow downardly between the back of housing and the horizontal and vertical members to a fluid collecting chamber, and a drain connected to the fluid collecting chamber for removing the fluid from the collecting chamber.

2. The coin handling mechanism of claim 1 wherein the coin passageway includes a plurality of vertical tabs extending outwardly from a front side of the water trap.

3. The coin handling mechanism of claim 1 wherein a plurality of vertical passageways are located between the vertical support members and wherein the coin passageway intersects with the vertical passageways.

4. The coin handling mechanism of claim 1 wherein the coin passageway comprises an outwardly extending projection from the front side of the water trap sloping downward towards the coin discharge chute.

5. The coin handling mechanism of claim 4 wherein a plurality of vertical passageways are located between the vertical support members and intersect with the outwardly extending projection.

6. The coin handling mechanism of claim 5 wherein a top surface of the outwardly extending projection includes a series of hills and dales.

7. The coin handling mechanism of claim 6 wherein the dales intersect with the vertical passageways.

8. The coin handling mechanism of claim 1 wherein at least some of the cross bar members further include deflection fins extending from a back side of the water trap towards the back of the housing.

9. The coin handling mechanism of claim 8 wherein the deflection fins are angled downwardly towards the fluid collecting chamber.

10. The coin handling mechanism of claim 4 wherein the outwardly extending projection slopes inwardly towards the front side of the water trap.

11. A coin handling mechanism for conveying coins to a remotely positioned coin receptor comprising:

a housing having a top, bottom, a front, a back and side walls, a coin receiving slot disposed at the top and front of the housing, a coin discharge chute disposed in the housing below the coin receiving slot, said discharge chute having an open top mounted to said housing and an open bottom a coin passageway within the housing for passing the coins from the coin receiving slot to the coin discharge chute, and means for adjusting the position of the discharge chute to vary a relative distance or orientation between the bottom of the discharge chute and said housing to properly align the discharge chute with a coin receptor.

12. The coin handling mechanism of claim 11 wherein the means for adjusting includes a tongue extension on the discharge chute, a clamp plate, and a pair of screws, wherein the clamp plate tightens sandwiches the tongue extension between the clamp plate and the front of the housing.

13. A liquid diverting coin handling mechanism for conveying coins to a remotely positioned coin receptor comprising:

a housing having a top, bottom, a front, a back, and side walls, a coin receiving slot disposed at the top and front of the housing, a coin discharge chute disposed in the housing below the coin receiving slot, a coin passageway upon which coins travel from the coin receiving slot to the coin discharge chute, a water trap positioned at the back of the housing and including a plurality openings therein, wherein water injected into the coin handling mechanism may travel through the openings and flow downardly between the back of housing and the openings in the water trap to a fluid collecting chamber, and a drain connected to the fluid collecting chamber for removing the fluid from the collecting chamber.

14. The coin handling mechanism of claim 13 wherein the coin passageway includes a plurality of vertical tabs extending outwardly from a front side of the water trap.

15. The coin handling mechanism of claim 13 wherein the coin passageway comprises an outwardly extending projection from the front side of the water trap sloping downward towards the coin discharge chute.

16. The coin handling mechanism of claim 15 wherein a top surface of the outwardly extending projection includes a series of hills and dales.

17. The coin handling mechanism of claim 16 wherein the dales intersect with the openings in the water trap.

* * * * *